United States Patent [19]

Downey

[11] Patent Number: 5,005,380

[45] Date of Patent: Apr. 9, 1991

[54] DUAL SPINDLE YARN SUPPORT AND DELIVERY APPARATUS

[76] Inventor: Patrick J. Downey, 283 4th Avenue West, North Bay Ontario, Canada

[21] Appl. No.: 470,376

[22] Filed: Jan. 25, 1990

[51] Int. Cl.[5] ..... D04B 3/06

[52] U.S. Cl. ..... 66/1 A; 66/125 R; 223/106; 242/134; 242/139

[58] Field of Search ..... 66/1 A, 125 R, 125 A; 112/258, 302; 242/129.5, 134, 139, 140; 223/106, 107

[56] References Cited

U.S. PATENT DOCUMENTS

| | | | |
|---|---|---|---|
| 579,652 | 3/1897 | Pherson | 223/107 X |
| 2,401,667 | 6/1946 | Segur | 223/107 |
| 3,302,903 | 2/1967 | Vogel | 112/302 X |
| 3,309,040 | 3/1967 | Stancil | 242/139 |

FOREIGN PATENT DOCUMENTS

| | | | |
|---|---|---|---|
| 652675 | 11/1937 | Fed. Rep. of Germany | 223/107 |
| 733405 | 3/1943 | Fed. Rep. of Germany | 223/107 |

*Primary Examiner*—Wm. Carter Reynolds
*Attorney, Agent, or Firm*—Leon Gilden

[57] ABSTRACT

Apparatus including a horizontal rectangular frame and a vertical rectangular frame receivable within the horizontal frame. The framework of the horizontal frame includes plural link members mounted vertically of a forward end of the horizontal rectangular frame and to an upper end of the vertical rectangular frame to pivotally receive the vertical rectangular frame within the horizontal rectangular frame. A propeller support brace is rotatably mounted to the vertical rectangular frame and includes a plurality of threaded bosses to threadedly mount a spaced plurality of yarn containers thereto where each yarn container is of a cylindrical configuration formed with a coaxial bore therethrough including an upper lid thereof to direct yarn therethrough.

9 Claims, 4 Drawing Sheets

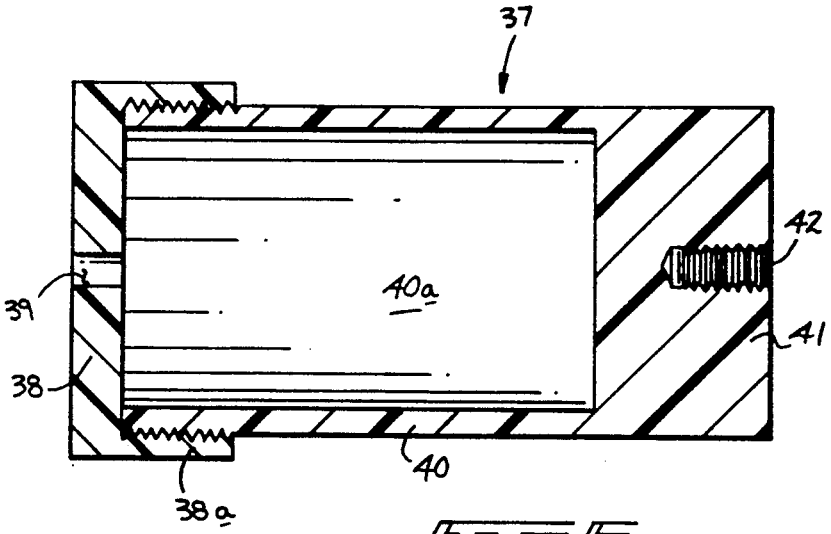
FIG 6
FIG 7
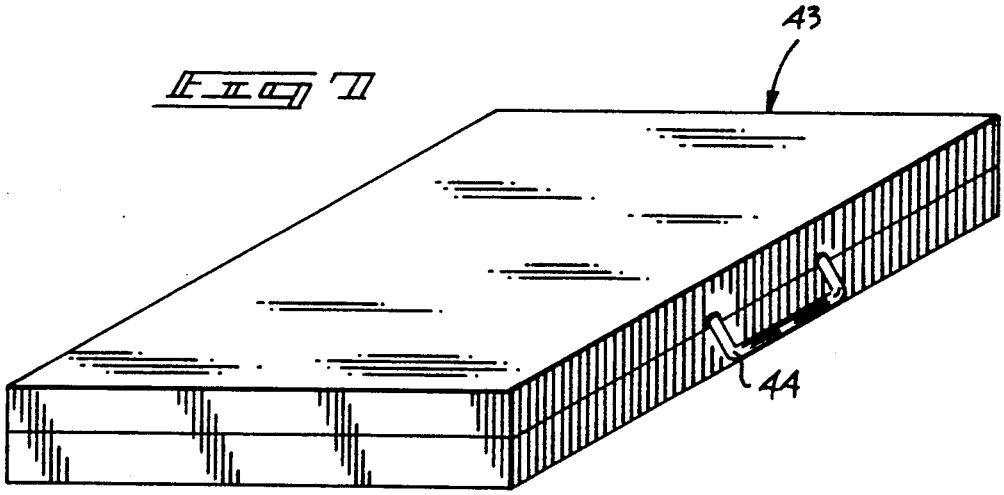

DUAL SPINDLE YARN SUPPORT AND DELIVERY APPARATUS

BACKGROUND OF THE INVENTION

1. Field of the Invention

The present invention relates to yarn support apparatus and will particularly pertain to the new and improved dual spindle yarn support and delivery apparatus wherein the same rotatively mounted the plurality of cylindrical spindles to permit dual delivery of yarn filaments during a plural filament weaving procedure.

2. Description of the Prior Art

The use of yarn support apparatus is well known in the prior art. The prior art has heretofore been of a cumbersome and expansive configuration as opposed to the invention which permits a knock-down organization receivable within a carrying case to enable portage thereof from one forum to another. An example of the prior art include U.S. Pat. No. 4,548,055 to MACDONALD where the patent utilizes a series of aligned parallelepiped containers where the containers include central bores to direct yarn therethrough. The present invention defines an improvement over the patent where the cylindrical containers of the invention permit a tangle free interweaving of yarn utilizing a dual filament weaving procedure as opposed to that of the MACDONALD patent setting forth a stationary series of containers.

U.S. Pat. No. 3,054,277 to BROSCHARD provides plural reels of yarn including elongate guide to direct the yarn therethrough. These reels are of a stationary configuration as is typical of the prior art.

U.S. Pat. No. 2,493,208 to SEDGEWICK provides an organization wherein a bracket member secures a series of bobbins to enable directing individual filament from the various bobbins through a weaving station.

U.S. Pat. No. 4,635,834 to LINDQUIST provides a teaching to disclose a series of compartments securing yarn rolls therewithin to enable directing of yarn from the rolls through associated apertures.

U.S. Pat. No. 4,724,687 to GARIBOLDI ET AL, wherein stacked reels of yarn are mounted through underlying guides to direct the yarn through a weaving organization positioned thereunder.

As such, it may be appreciated there appears to be a need for a new and improved dual spindle yarn support and delivery apparatus where the same permits the tangle free delivery and directing of spaced yarn filaments in a dual filament weaving procedure.

SUMMARY OF THE INVENTION

In view of the foregoing disadvantages inherent in the known types of yarn support apparatus now present in the prior art, the present invention provides an improved dual spindle yarn support and delivery apparatus wherein the same permits a tangle free delivery of yarn in a dual yarn knitting procedure. As such, the general purpose of the present invention, which will be described subsequently in greater detail, is to provide a new and improved dual spindle yarn support and delivery apparatus which has all the advantages of the prior art yarn support apparatus and none of the disadvantages.

To attain this, the dual spindle yarn support apparatus of the invention includes apparatus comprising a horizontal rectangular frame and a vertical rectangular frame receivable within the horizontal frame. The framework of the horizontal frame includes plural link members mounted vertically of a forward end of the horizontal rectangular frame and to an upper end of the vertical rectangular frame to pivotally receive the vertical rectangular frame within the horizontal rectangular frame. A propeller support brace is pivotally mounted to the vertical rectangular frame and includes a plurality of threaded bosses to threadedly mount a spaced plurality of yarn containers thereto wherein each yarn container is of a cylindrical configuration formed with a coaxial bore therethrough including an upper lid thereof to direct yarn therethrough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefor, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dual spindle yarn support and delivery apparatus which has all the advantages of the prior art yarn support and delivery apparatus and none of the disadvantages.

It is another object of the present invention to provide a new and improved dual support and delivery apparatus which may be easily and efficiently manufactured and marketed.

It is a further object of the present invention to provide a new and improved dual spindle yarn support and delivery apparatus which is of a durable and reliable construction.

An even further object of the present invention is to provide a new and improved dual spindle yarn support and delivery apparatus which is susceptible of a low cost of manufacture with regard to both materials and labor, and which accordingly is then susceptible of low prices of sale to the consuming public, thereby making such dual spindle yarn support and delivery apparatuses economically available to the buying public.

Still yet another object of the present invention is to provide a new and improved dual spindle yarn support and delivery apparatus which provides in the apparatuses and methods of the prior art some of the advantages thereof, while simultaneously overcoming some of the disadvantages normally associated therewith.

Still another object of the present invention is to provide a new and improved dual spindle yarn support and delivery apparatus which may be compactly stored during periods of non-use.

Yet another object of the present invention is to provide a new and improved dual spindle yarn support and delivery apparatus where the same permits a directing, in a tangle free manner, a plurality of filaments from a like plurality of horizontally mounted yarn support containers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic view taken along the lines 6—6 of FIG. 4 in the direction indicated by the arrows.

FIG. 7 is an isometric illustration of a carrying case utilized by the instant invention.

DESCRIPTION OF THE PREFERRED EMBODIMENT

Figure 1:
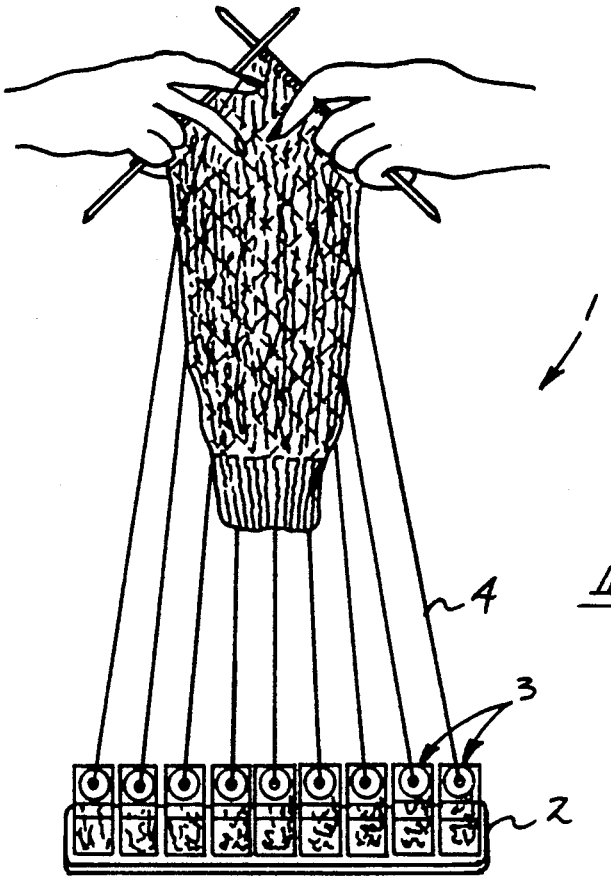
Fig 1 PRIOR ART
FIG. 1 is an isometric illustration of a prior art yarn support delivery apparatus.

With reference now to the drawings, and in particular to FIGS. 1 to 7 thereof, a new and improved dual spindle yarn support and delivery apparatus embodying the principles and concepts of the present invention and generally designated by the reference numeral 10 will be described.

Figure 2:
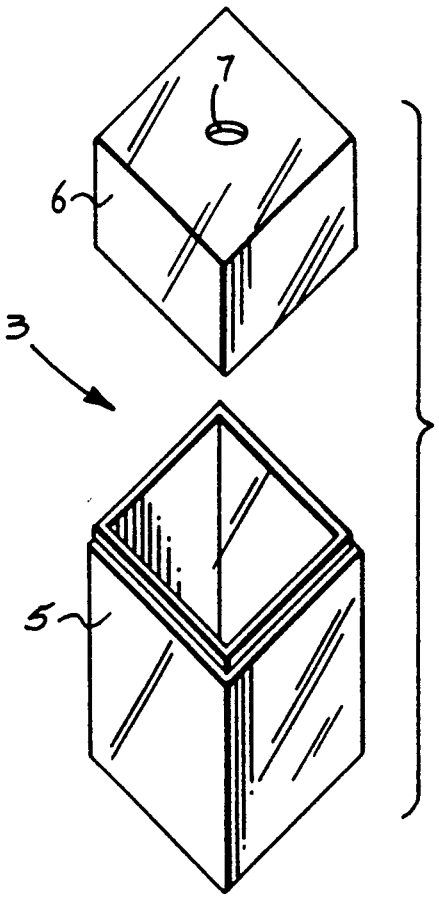
Fig 2 PRIOR ART
FIG. 2 is an isometric exploded view of a prior art yarn support container.

FIG. 1 is illustrative of a prior art yarn delivery organization 1 wherein an elongate base 2 mounts a series of yarn containers 3 to deliver various yarn filaments 4 therefrom to a knitting procedure. FIG. 2 illustrates the container 3 formed with a base 5 receiving a cap 6 thereon where the cap is forming with a central aperture 7 therethrough to deliver the yarn filaments 4 therethrough. The generally rectangular configuration of the containers 3 discourages a rotatable delivery system as utilized by the instant invention.

Figure 3:
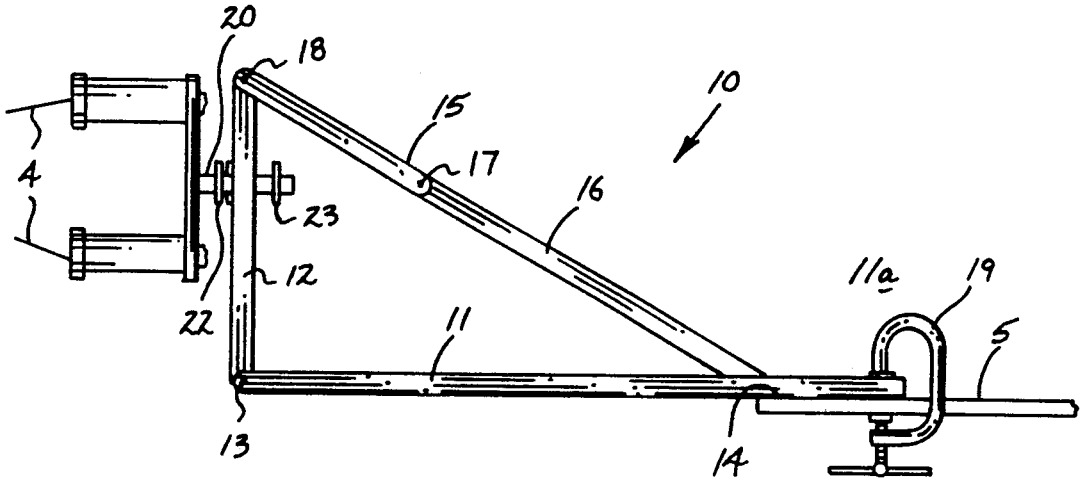
FIG. 3 is an orthographic side view taken elevation of the instant invention.
Figure 4:
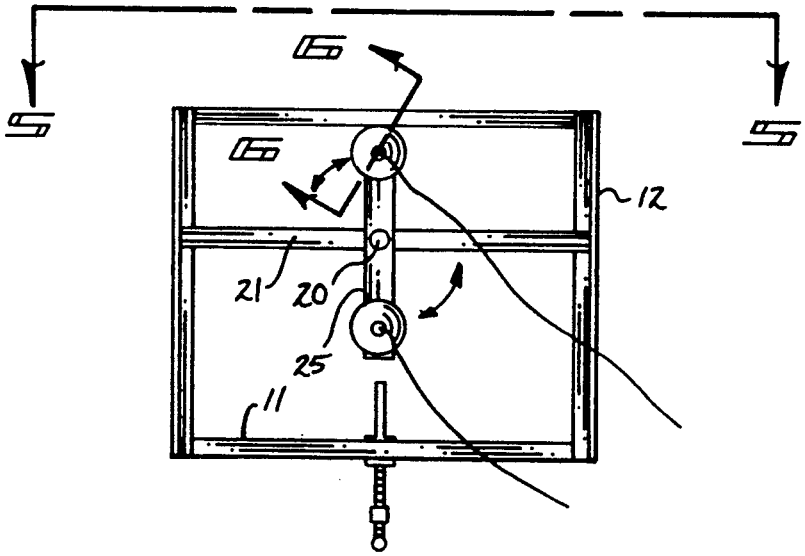
FIG. 4 is an orthographic rear view taken elevation of the instant invention.
Figure 5:
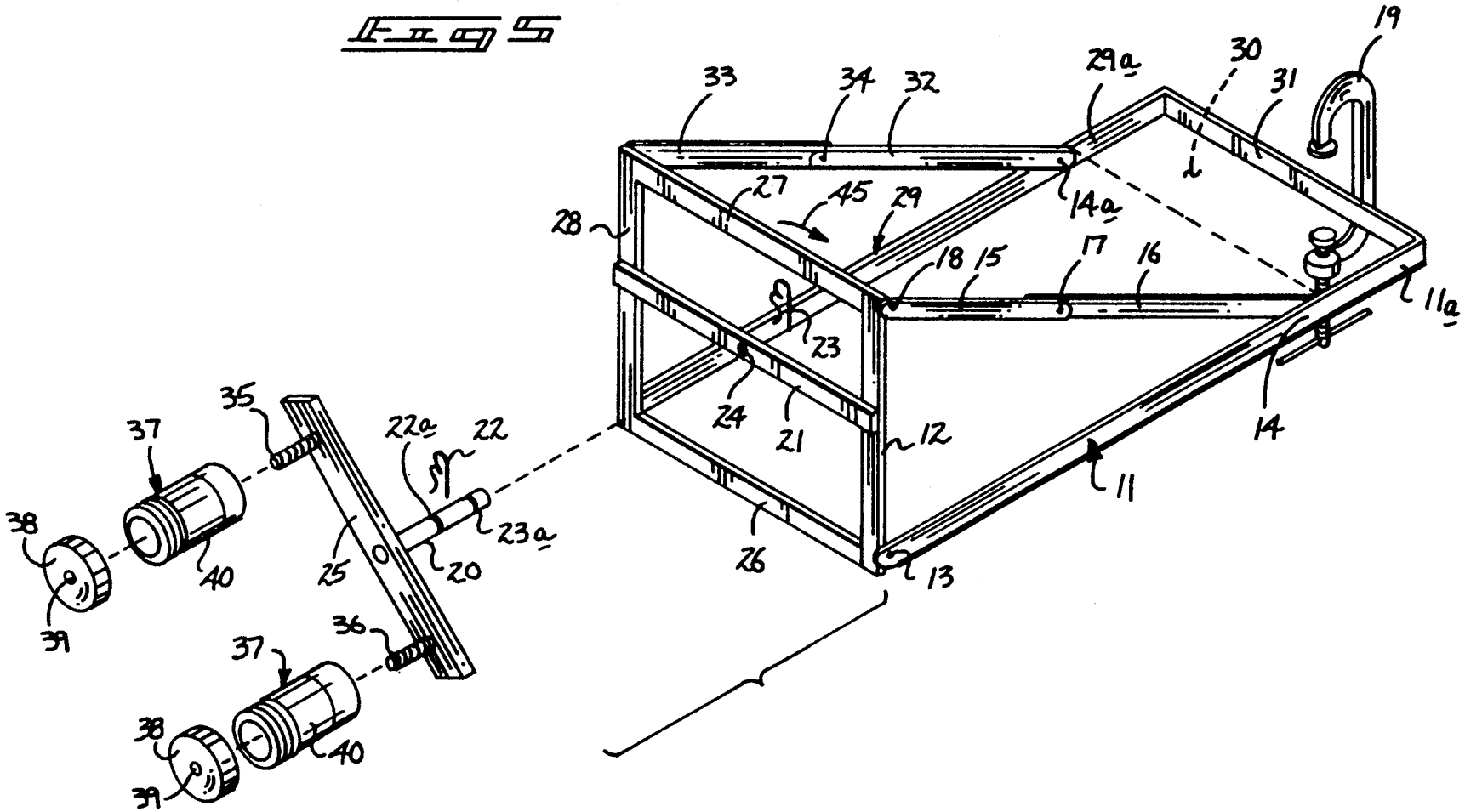
FIG. 5 is an orthographic view taken along lines 5—5 of FIG. 4 in the direction indicated by the arrows.

More specifically, the dual spindle yarn support and delivery apparatus of the invention essentially comprises, a horizontal framework receiving a vertical framework pivotally therewithin as illustrated in FIG. 5 for example. The horizontal framework includes a first horizontal support leg 11 spaced from and parallel to a second horizontal support leg 29. The first and second horizontal support legs include respective forward portions 11*a* and 29*a* extending beyond respective forward pivots defined by a second pivot point 14 and an associated further second pivot point 14*a*. Similarly a first pivot 13 joins a forward terminal end of the first support leg 11 to a first vertical support leg 12 of the vertical framework wherein the second horizontal support leg 29 is joined by a like further first pivot (not shown) to the second vertical support leg 28. The first and second vertical support legs 12 and 28 are spaced parallel to one another and mounted interiorly of the parallel first and second horizontal support legs 11 and 29 respectively. A forward frame leg 31 is orthogonally mounted between forward terminal ends of the first and second forward portions 11*a* and 29*a* to complete the horizontal framework wherein a clamping plate 30, as illustrated in FIG. 5 for example, may be optionally employed to overly the forward portions to enhance securement to a supports surfaces as illustrated in FIG. 3 by the associated clamp member 19 defined as a C shaped clamp.

The first and second vertical support legs 12 and 28 include articulated support linkage to an enable pivotment of the vertical framework interiorally of the horizontal framework per the directional arrow 45 is illustrated in FIG. 5. An upper right link 15 and a lower right link 16 are pivotally mounted relative to one another by a first intermediate pivot connection 17 with an upper right pivot connection 18 pivotally mounting the upper right leg 15 to an upper terminal end of the first vertical support leg 12. The second pivot 14 pivotally mounts the lower terminal end of the first lower right leg 16 to the first horizontal support leg 11 adjacent the further portion of the first horizontal support leg 11*a*. Similarly a lower left link 32 and an upper left link 33 are joined together by a second intermediate pivot connection 34 with the further second pivot 14*a* joining the lower terminal end of the lower left leg 32 in alignment with the second pivot 14. Similarly a further upper right pivot connection 18 pivotally joins the upper terminal end of the upper left link 33 to an upper terminal end of the second vertical support leg 28. A top horizontal frame member 27 is orthogonally mounted to upper terminal ends of the first vertical support leg 12 and the second vertical support leg 28 with the parallel second vertical support leg 28 joining lower terminal ends of the same vertical support leg. An intermediately positioned cross shaft 21 is integrally mounted to intermediate portions of the first vertical support leg 12 and the second vertical support leg 28. A bushing bore 24 rotatably receives the rotatable shaft 20 therewithin which in turn includes a cross propeller support brace 25 fixedly mounted to a forward terminal end of the rotatable shaft 20. The shaft 20 includes a first circumferential shaft groove 22*a* and a second circumferential shaft groove 23*a* spaced apart a predetermined distance equal to a predetermined width of the cross shaft 21 to rotatably secure the shaft 20 within the bushing bore 24 utilizing spaced first and second u-shaped spring clip member 22 and 23 secured in the respective shaft grooves 22*a* and 23*a* capturing member 22 and 23 forward and rear surfaces of the associated cross shaft 21 therebetween. A first threaded boss 35 and a second threaded boss 36 are orthogonally and outwardly and fixedly mounted adjacent opposed terminal ends of the support brace 25. Threadedly mounted to back of the respective threaded bosses 35 and 36 are yarn containers 37.

Each yarn container 37 is defined as a cylindrical container including an upper threaded end receiving a threadedly mounted cap 38 thereto which includes an internally threaded downwardly directed annular skirt 38*a* to threadedly secure the cap 38 to the cylindrical body 40 of the yarn container 37. A yarn cavity 40*a* is thereby defined within the yarn container 37 wherein the associated yarn is directed outwardly thereof through a central bore 39 coaxially aligned with the cap 38.

The base 41 of the yarn container 37 is defined by a predetermined axial height that includes a coaxially aligned threaded bore 42 directed interiorly of the base 41 from an exterior surface interiorially thereof and is defined by a length less than the axial height of the base 41 to fixedly receive an associated boss 35 or 36 therewithin.

In use, the yarn containers 37 are free to rotate about the cross shaft 21 and are used to form a tangle free delivery of associated filaments 4 directed from within the yarn container as illustrated in FIG. 3 for example.

FIG. 7 illustrates a carrying case 43 formed with a handle 44 to receive the apparatus 10 when in closed configuration. The apparatus is collapsed by directing the first intermediate pivot connection 17 and the second intermediate pivot connection 34 downwardly towards the first and second horizontal support legs 11 and 29 to enable collapsing of the vertical framework downwardly relatively towards the horizontal framework. The shaft 20 and associated structure is removed from the bushing bore 24 and also positioned within the case 43 for subsequent transport thereof.

As to the manner of use the operation of the instant invention, the same should be apparent when the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dual spindle yarn support and delivery apparatus comprising:

a lower horizontal rectangular framework and a vertical rectangular framework pivotally mounted to and interiorially of the horizontal rectangular framework, and a respective right and left linkage means mounted between the respective right and left side portions of the lower horizontal framework and the vertical framework for pivotally positioning the vertical rectangular framework relative to the horizontal rectangular framework, and a shaft rotatably mounted to the vertical rectangular framework adjacent a rear terminal end of the shaft, and a propeller brace orthogonally and fixedly mounted to a forward terminal end the propeller brace medially of the propeller brace, and a respective first and second yarn container mounted adjacent respective opposed terminal ends of the propeller brace.

2. An apparatus as set forth in claim 1 wherein the first and second yarn container each comprise generally cylindrical containers, each cylindrical container includes a cylindrical body including an externally threaded upper terminal end and a base opposed to the upper terminal end wherein the base is defined by a predetermined axial height, and a threaded bore axially formed within the base a distance less than the predetermined axial height, and an annular lid defined including a downwardly depending internally threaded skirt threadedly securable to the upper terminal end of the cylindrical body, and a central bore coaxially formed through the lid, and a threaded boss mounted fixedly and orthogonally adjacent the terminal ends of the propeller brace to receive the threaded bore of each yarn container thereon.

3. Apparatus set forth in claim 2 wherein the shaft comprises elongate cylindrical body including spaced annular grooves positioned adjacent a rear terminal end of the shaft spaced apart a fixed distance, and spring clips selectively receivable within each of the annular grooves.

4. An apparatus set forth in claim 3 wherein the vertical rectangular framework includes a cross brace directed horizontally and orthogonally across the vertical rectangular framework, the cross brace including a bushing bore therewithin to rotatably receive the shaft therewithin.

5. An apparatus set forth in claim 4 wherein the rectangular framework includes a top brace and a bottom brace parallel to and spaced from the cross brace and orthogonally and inwardly mounted to right and left vertical legs defining the vertical rectangular framework, the right and left vertical legs including right and left pivots mounted to right and left horizontal legs defined by the horizontal rectangular framework.

6. An apparatus set forth in claim 5 wherein the right and left linkage means each includes an upper and lower link member, the upper and lower link member of each right and left linkage means further includes a intermediate pivot connection therebetween, and an upper pivot connection pivotally mounting the upper link to an upper end of a respective vertical leg of the vertical rectangular framework, and a lower pivot connecting the lower link to a respective right and left leg of the horizontal framework.

7. An apparatus set forth in claim 6 where the horizontal rectangular framework further includes a forward frame leg orthogonally and integrally mounting the right and left horizontal legs together, and a clamping plate mounted forwardly of the linkage means overlying the forward frame leg and the respective right and left horizontal legs.

8. An apparatus set forth in claim 7 further including a clamp member to clamp the horizontal rectangular framework to a support surface.

9. An apparatus as set forth in claim 8 wherein the clamp is defined as a C clamp.

* * * * *